US006749134B2

(12) United States Patent
Arenson et al.

(10) Patent No.: US 6,749,134 B2
(45) Date of Patent: Jun. 15, 2004

(54) SPRAY NOZZLE ASSEMBLY WITH AUXILIARY HIGH VOLUME SPRAY NOZZLE

(75) Inventors: Marc A. Arenson, Carol Stream, IL (US); Stephen L. Pearson, Wheaton, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/883,663

(22) Filed: Jun. 18, 2001

(65) Prior Publication Data

US 2002/0190140 A1 Dec. 19, 2002

(51) Int. Cl.[7] ..... A62C 31/02
(52) U.S. Cl. ..... 239/393; 239/394; 239/442; 239/443
(58) Field of Search ..... 237/390–394, 237/397, 442, 443, 266, 268

(56) References Cited

U.S. PATENT DOCUMENTS 3,779,533 A * 12/1973 Etter
3,863,841 A * 2/1975 Berthould ..... 239/266
4,058,260 A * 11/1977 Lestradet
5,125,578 A * 6/1992 Ballu ..... 239/394

* cited by examiner

*Primary Examiner*—Christopher Kim
(74) *Attorney, Agent, or Firm*—Leydig, Voit & Mayer, Ltd.

(57) ABSTRACT

A turret-type spray nozzle assembly having a rotatable turret which carries a plurality of spray nozzles and which is rotatable on the nozzle body for locating a selected one of the turret nozzles in an operative spray position. The spray nozzle assembly further includes an auxiliary spray nozzle adapted for directing a higher volume liquid spray than any one of the turret spray nozzles. The spray nozzle assembly includes a body which defines a more direct liquid flow passage, with fewer turns and lesser pressure losses, to the auxiliary nozzle than to a turret spray nozzle. An adaptor also is disclosed for convenient field conversion of a conventional turret spray nozzle into a nozzle assembly according to the invention.

25 Claims, 3 Drawing Sheets

SPRAY NOZZLE ASSEMBLY WITH AUXILIARY HIGH VOLUME SPRAY NOZZLE

FIELD OF THE INVENTION

The present invention relates generally to spray nozzle assemblies, and more particularly, to spray nozzle assemblies having a rotatable turret carrying a multiplicity of different spray tips for selected indexing to an operative position.

BACKGROUND OF THE INVENTION

Known turret-type spray nozzles commonly comprise a nozzle body, typically mounted in dependent fashion from a liquid supply boom or the like, having a transversely extending generally cylindrical turret mounting section, and a turret rotatably mounted on the cylindrical body section carrying a plurality of circumferentially spaced radially extending spray nozzles such that a selected spray nozzle may be brought into a position for discharging a desired liquid spray pattern, typically in a downward direction, for the specific spray application. A problem with such turret type spray nozzle assemblies is that by reason of the multiplicity of turns, the length of travel, and the various flow restrictions for the supply liquid from a liquid inlet to the selected spray nozzle, significant pressure losses can occur that limit the flow capacity, namely liquid flow volume, for any nozzle indexed to the operative spray position for a given liquid inlet pressure. Hence, while such turret type spray nozzles permit the discharge of different spray patterns, the flow rate through any one of the indexed nozzles is limited.

OBJECTS AND SUMMARY OF THE INVENTION

It is an object of the present invention to provide a turret-type spray nozzle assembly which enables the selective direction of a relatively higher volume of liquid spray for a given liquid inlet pressure.

Another object is to provide a spray nozzle assembly as characterized above which is adapted to selectively direct a liquid spray pattern having at least twice the liquid volume of any one of the plurality of turret-mounted spray nozzles for a given inlet pressure.

A further object is to provide a spray nozzle assembly of the foregoing type which includes a multiplicity of spray nozzles that can be selectively used in spraying and in which a substantially greater volume of liquid may be directed from at least one of the nozzles for a given liquid inlet pressure than from any of the other nozzles of the assembly.

Another object is to provide a spray nozzle assembly of the foregoing type which is relatively simple in construction and which lends itself to economical manufacture.

Still another object is to provide a nozzle adaptor which permits easy field conversion of conventional nozzles to a nozzle according to the present invention.

Other objects and advantages of the invention will become apparent upon reading the following detailed description and upon reference to the drawings, in which:

Figure 1:
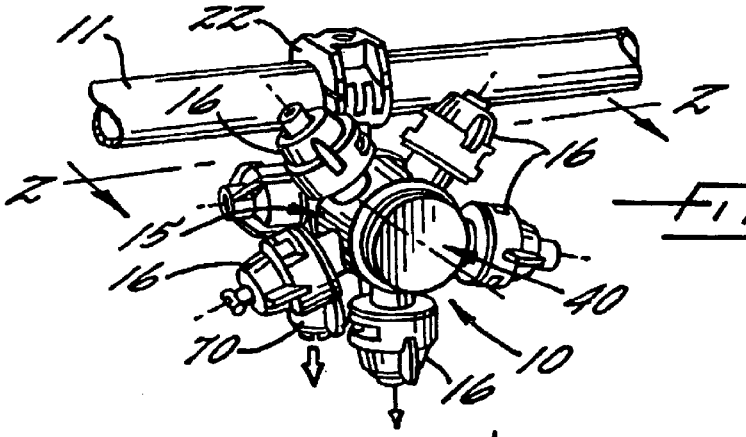
FIG. 1 is a perspective of an illustrative spray nozzle assembly embodying the present invention mounted on a liquid supply boom.
Figure 2:
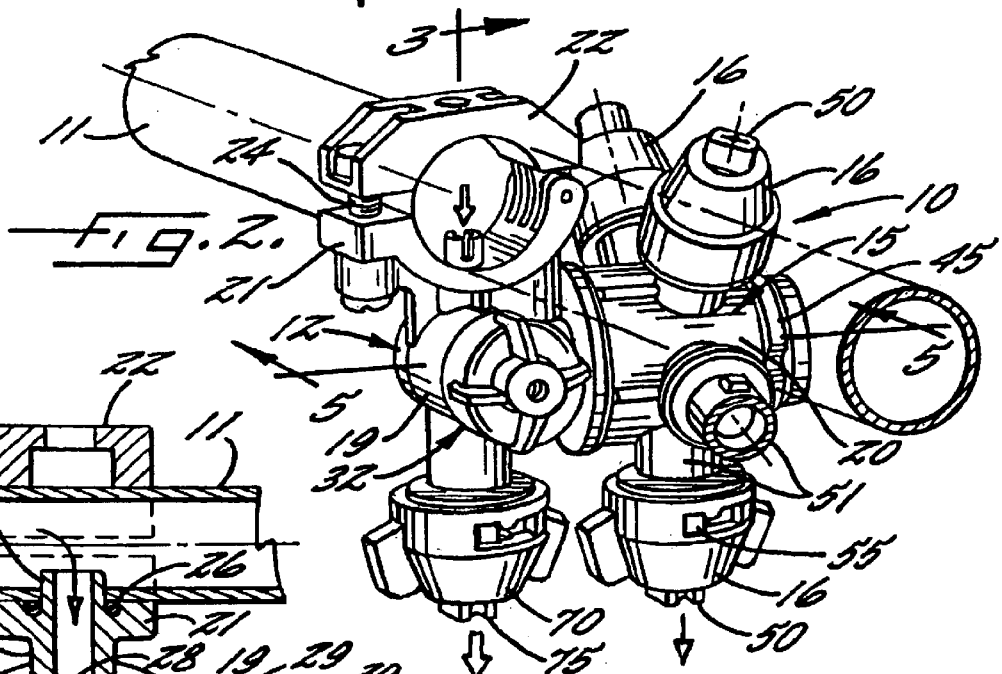
FIG. 2 is an enlarged perspective of the spray nozzle assembly shown in FIG. 1.
Figure 3:
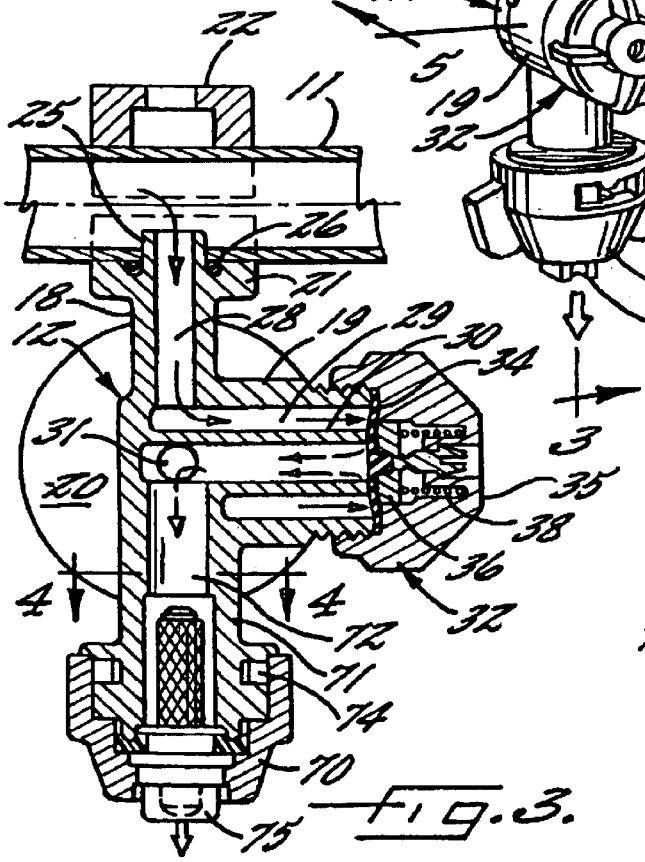
FIG. 3 is an enlarged vertical section of the illustrative spray nozzle assembly taken in the plane of line 3—3 in FIG. 2.
Figure 4:
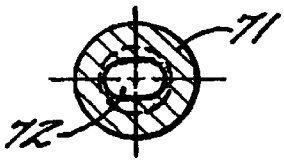
FIG. 4 is a transverse section of the spray nozzle body of the illustrative assembly taken in the plane of line 4—4 in FIG. 3.
Figure 5:
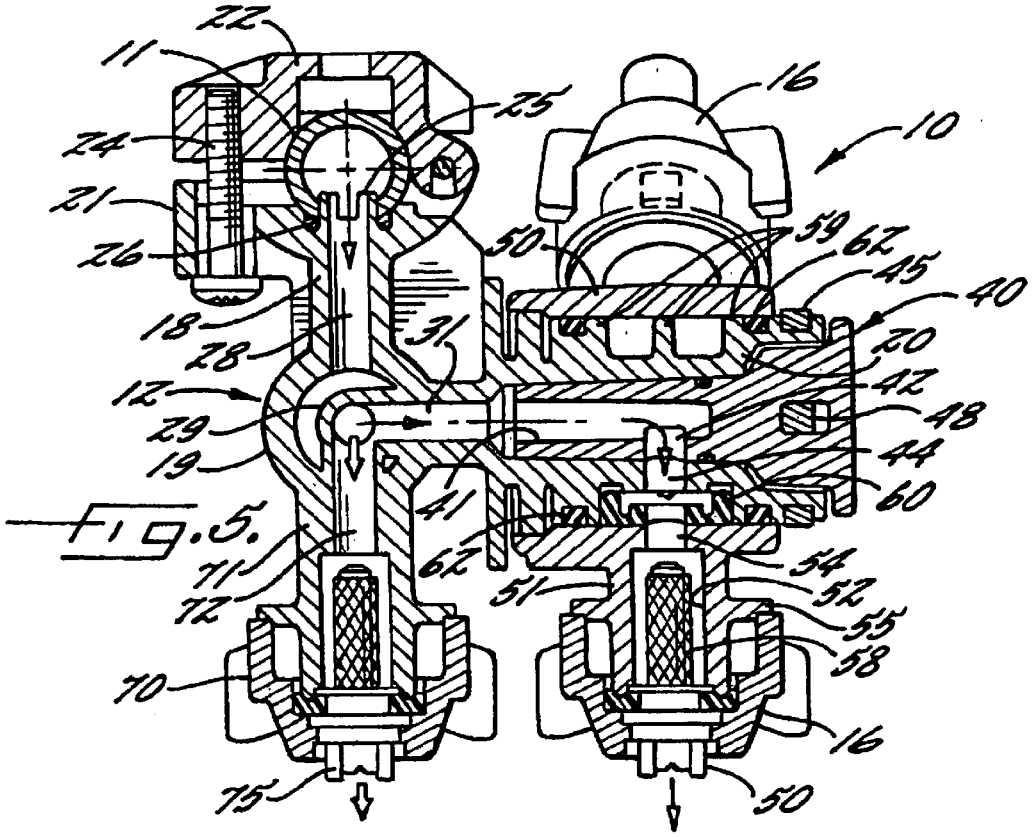
FIG. 5 is an enlarged vertical section of the illustrative spray nozzle assembly taken in the plane of line 5—5 in FIG. 2.
Figure 6:
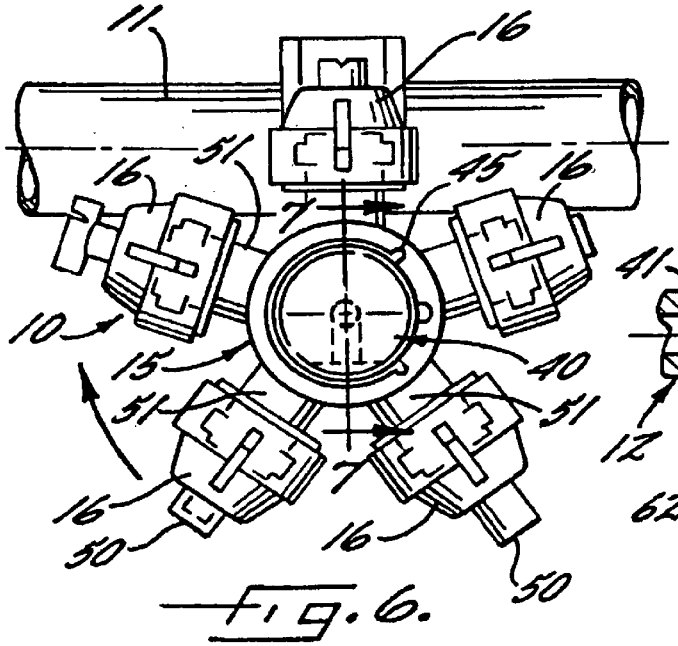
FIG. 6 is a side elevational view of the illustrative spray nozzle assembly from the turret side thereof.
Figure 7:
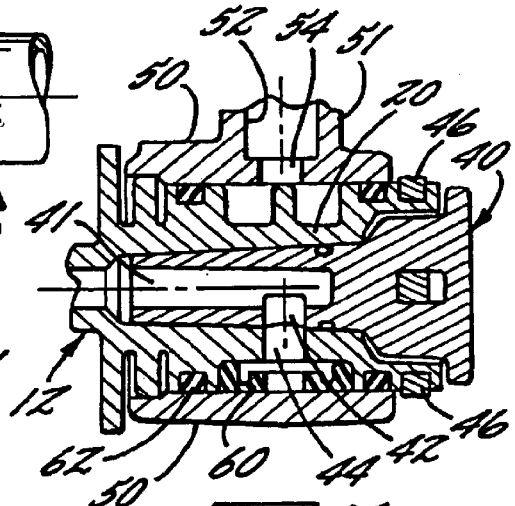
FIG. 7 is a fragmentary vertical section of the turret mounting of the illustrative spray nozzle assembly taken in the plane of line 7—7 in FIG. 6.

While the invention is susceptible of various modifications and alternative constructions, a certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DESCRIPTION OF THE PREFERRED EMBODIMENTS

Referring now more particularly to FIGS. 1–7 of the drawings, there is shown an illustrative turret type spray nozzle assembly 10 embodying the present invention which in this case is mounted on liquid supply boom 11. The spray nozzle assembly 10 includes a nozzle body 12 supported in depending fashioned from the liquid supply boom 11, and a turret 15 which carries a plurality of circumferentially-spaced and radially extending spray nozzles 16 and is rotatable on the nozzle body 12 for indexing a selected spray nozzle 16 into an operative downwardly directed position. It will be understood by one skilled in the art that a plurality of such spray nozzle assemblies 10 typically may be mounted at longitudinal spaced positions along the liquid supply boom 11.

The nozzle body 12 in this instance basically comprises a mounting and liquid inlet section 18 supported below the liquid supply boom 11, a generally cylindrical check valve hub section 19 disposed below the mounting and inlet section 18 in parallel relation to the liquid supply boom 11, and a generally cylindrical horizontal, transversely extending turret mounting section 20. For securing the spray nozzle assembly 10 to the supply boom 11, the mounting section 18 includes an integrally formed cradle-shaped mounting flange or clamp 21 positionable adjacent an underside of the boom 11 and a clamping element 22 pivotally connected to one end of the mounting flange 21 and positionable over the boom 11 for securement to an opposite end of the mounting flange 21 by a fastening screw 24.

The mounting and inlet section 18 of the nozzle body 12 includes a nipple 25 which extends into the boom 11 through an aperture in the underside. An O-ring seal 26 is positioned about the nipple 25 in interposed relation between the body mounting flange 21 and the liquid supply boom 11. Pressurized liquid from an appropriate source supplied to the boom 11 enters the nipple 25 and passes downwardly through an inlet passage 28 in the nozzle body 12. The nozzle body inlet passage 28 communicates with an annular chamber or passage 29 defined between a horizontal tube 30 (FIG. 3) and an internal wall of the cylindrical hub section 19 of the body. The horizontal tube 30 is fixed at one end within the hub section such that liquid travels in one direction through the annular chamber 29 for communication into an end of the tube for travel in an opposite horizontal direction. Liquid in the tube 30 communicates with a 90° angled passage 31 which extends coaxially into the cylindrical turret mounting section 21 of the nozzle body 12.

For preventing liquid from dripping from a spray nozzle assembly 10 after the supply of pressurized liquid to the nozzle assembly has been cut off, a spring-operated check valve 32 is provided on the hub section 19. The check valve 32 includes a flexible diaphragm 34 located adjacent the end of the flow tube 30 with its peripheral edge clamped between the end of the hub section 19 of the nozzle body and a cap 35 threaded onto the hub section 19. A valve follower 36 is slidably supported within the cap 35 in engaging relation with the diaphragm 34 for urging the diaphragm toward a closed position against the upstream end of the tube 30 under the biasing force of a spring 38. When the pressure of the liquid delivered to the nozzle assembly 10 via the supply boom 11 exceeds the force of the spring 38, the pressurized liquid urges the diaphragm 34 away from the end of the tube 30 so as to enable liquid flow through the tube 30, to the turret mounting section passage 31, and ultimately to the appropriately indexed spray nozzle 16. Upon shutting off of pressurized liquid from the supply source, the spring 38 forces the diaphragm 34 into sealing engagement with the end of the tube 30 to prevent further liquid from discharging or dripping from the spray nozzle 16.

To minimize the amount of liquid within the turret mounting section passage 20, and hence, further minimize liquid drippage from a nozzle upon liquid shutoff, a plug 40 (FIGS. 5 and 7) is mounted in an outboard end of the turret mounting section 20. The plug 40 has a coaxial tubular portion that defines a smaller diameter liquid passage 41 that communicates with the turret mounting section passage 31. The plug passage 41 communicates with a downwardly directed right angle or radial passage 42 in the plug, which in turn communicates with a radial exit passage 44 in the underside of the turret mounting section 20 of the nozzle body 12. For ensuring proper alignment of the radial passages 42, 44, the plug may be provided with an appropriate axially extending alignment nib that is positionable within an alignment notch in the end of the turret mounting section 20 of the nozzle body during assembly of the plug into the nozzle body. For securing the plug 40 in assembled position, a generally C-shaped retainer clip 45 (FIG. 6) is positioned about an end of the turret mounting section 20. Resilient arms 46 (FIG. 7) of the clip 45 can be snapped into an annular channel in the end of the turret mounting section 20 with a central locking lug 48 of the clip extending through aligned apertures in the turret mounting section 20 and the plug 40.

The turret 15 in this instance includes a cylindrical hub 50 rotatably mountable on the turret mounting section 20 and a plurality of circumferentially spaced nozzle mounting stems 51 extending radially outwardly of the hub 50. Each stem 51 has a central liquid flow passageway 52 communicating with a respective radial passage 54 through the turret hub 50, which in turn can be selectively brought into aligned relation with the radial exit passage 44 in the turret mounting section 20 by rotational movement of the turret 15. Each stem 51 includes diametrically opposed radial camming and locking lugs 55 for receiving a quick disconnect nozzle 16, such as shown in U.S. Pat. No. 4,527,745 assigned to the same assignee as the present application, the disclosure of which is incorporated herein by reference. Each spray nozzle 16 has a replaceable spray tip 50 for desired spray discharge. Liquid flow through stem passages 52, 54 to the respective spray tip, in each case, communicates through a strainer 58.

For supporting the turret for relative rotational movement on the nozzle body 12, the turret mounting section 20 is formed with a plurality of axially spaced cylindrical ribs 59 which define a cylindrical mounting surface. To prevent leakage between the turret 15 and nozzle body 12, an annular seal 60 having a liquid passage co-axially aligned with the radial exit passages 42, 44 is supported within a counter bore in the underside of the turret mounting section 20. To provide redundant sealing and create sufficient frictional resistance between the turret 15 and turret mounting section 20 such that the turret 15 is retained at a selected rotated position on the nozzle body 12, the turret mounting section 20 includes a pair of O-rings 61 disposed on opposite axial sides of the exit passageway seal 60. Hence, as will be understood by a person skilled in the art, the turret may be rotatably indexed to position any one of the plurality of nozzles 16 into operative position, in this case downwardly directed, with the stem passageways 52, 54 of the indexed nozzle 16 communicating with the radial exit passages 42, 44 of the nozzle body. Alternatively, the turret 15 may be indexed to an intermediate position, wherein none of the stem passages 52, 54 are aligned with the radial exit passages 42, 44 such that there is no discharge from any turret spray nozzle 15 even though pressurized liquid continues to be communicated to the nozzle body inlet 28.

It will be seen from the foregoing that the liquid to be sprayed through any of the turret nozzles 15 must proceed along a relatively torturous route. Liquid must travel through the inlet passage 28, make a right angle turn through the annular chamber 29, then reverse direction for travel through the tube 30, then turn 90° for travel through the axial turret passage 31, then turn 90° for passage through the nozzle body exit passages 42, 44 and valve stem passages 52, 54 for ultimate discharge from the spray nozzle 16. As indicated above, such travel creates pressure losses which can limit the liquid throughput for a particular liquid inlet pressure to flow rates less than often desired or required for a particular spray application.

In accordance with the invention, the turret spray nozzle assembly includes an auxiliary spray nozzle which can be selectively used for discharging a higher volume spray than any one of the turret mounted spray nozzles. To this end, the spray nozzle assembly 10 includes an auxiliary spray nozzle 70 mounted on an auxiliary stem or body section 71 disposed below the mounting and inlet section 18 for permitting a more direct and higher volume liquid discharge with reduced pressure losses. The auxiliary stem 71 in this instance is an integral part of the nozzle body 12 and extends from the underside of the hub section 19 in coaxial relation to the inlet passage 18. The auxiliary stem 71, like the turret nozzle stems 51, has a central flow passage 72 and radial locking and camming lugs 74 for removably receiving a quick disconnect spray nozzle 70 having a spray tip 75 for the desired spray application. Pressurized liquid passing through the check valve tube 30 communicates directly with the auxiliary stem passage 72 for direct passage to the auxiliary nozzle 70. It will be understood by one skilled in the art that liquid flow from the check valve 32 to the auxiliary nozzle is substantially shorter in length, has lesser turns, and incurs lesser pressure losses than liquid communicated to a turret spray nozzle 16. Hence, the auxiliary passage 72 may be larger in size and accommodate a substantially greater liquid flow through than the stem passage 54 of the turret nozzles 16.

In practice, the auxiliary stem passage preferably has a diameter which is at least 15° greater than the diameter of the comparable turret nozzle stem passages and enables a liquid flow through the auxiliary nozzle 70 that is about twice the capacity of any one of the turret spray nozzles 16 for a given liquid inlet pressure. To further enhance the liquid flow through the auxiliary spray nozzle, the auxiliary stem passage 72 in this case has an oblong cross section (FIG. 4), oriented parallel to the axis of the liquid supply tube 30 for enabling a greater liquid passage, without altering the geometry of the hub section 19, and particularly, the annular passage 29 and the tube 30, which also supply liquid to the turret nozzles 16.

From the foregoing, it will be understood by one skilled in the art that the spray nozzle assembly of the present invention has enhanced versatility in spraying. By rotating the turret 15 to an intermediate position, such that none of the turret nozzles 16 are in an operative position, a relatively high capacity liquid spray may be directed through the auxiliary nozzle 70. On the other hand, indexing one of the turret nozzles 16 into the operative position enables simultaneous spraying of different volumes of liquid through a selected turret nozzle 16 and through the auxiliary nozzle 70. Finally, replacing the auxiliary nozzle 70 with a dummy nozzle, namely one which does not have a spray-type orifice, enables spraying to be carried out by a selected turret nozzle 16 in a conventional manner.

Figure 8:
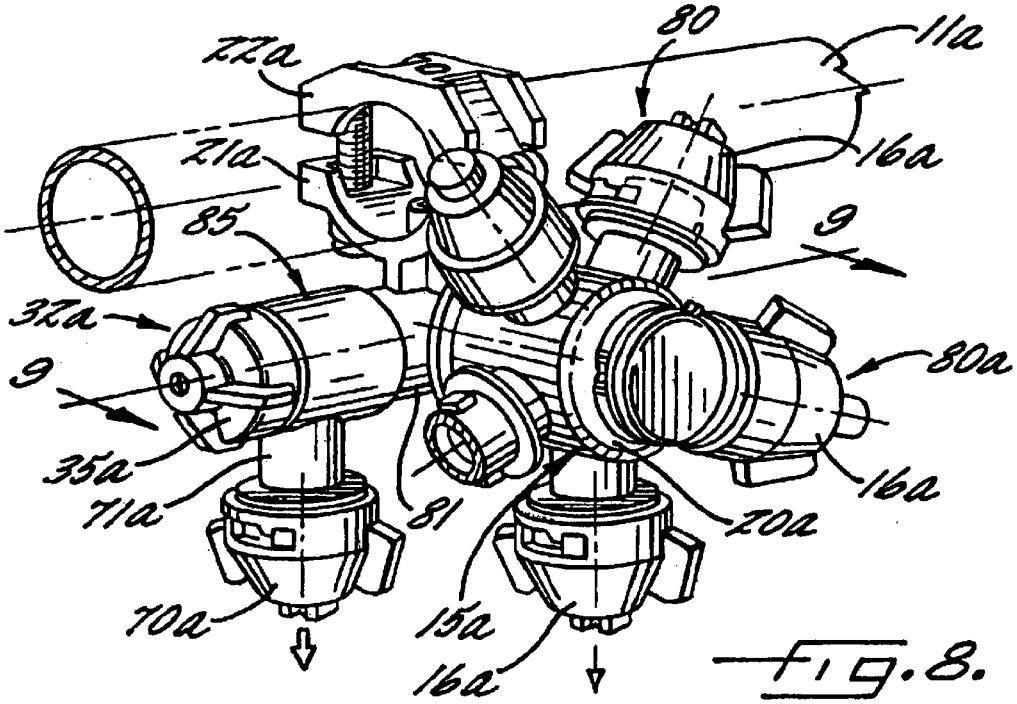
FIG. 8 is a perspective of an alternative embodiment of a spray nozzle assembly in accordance with the present invention.
Figure 9:
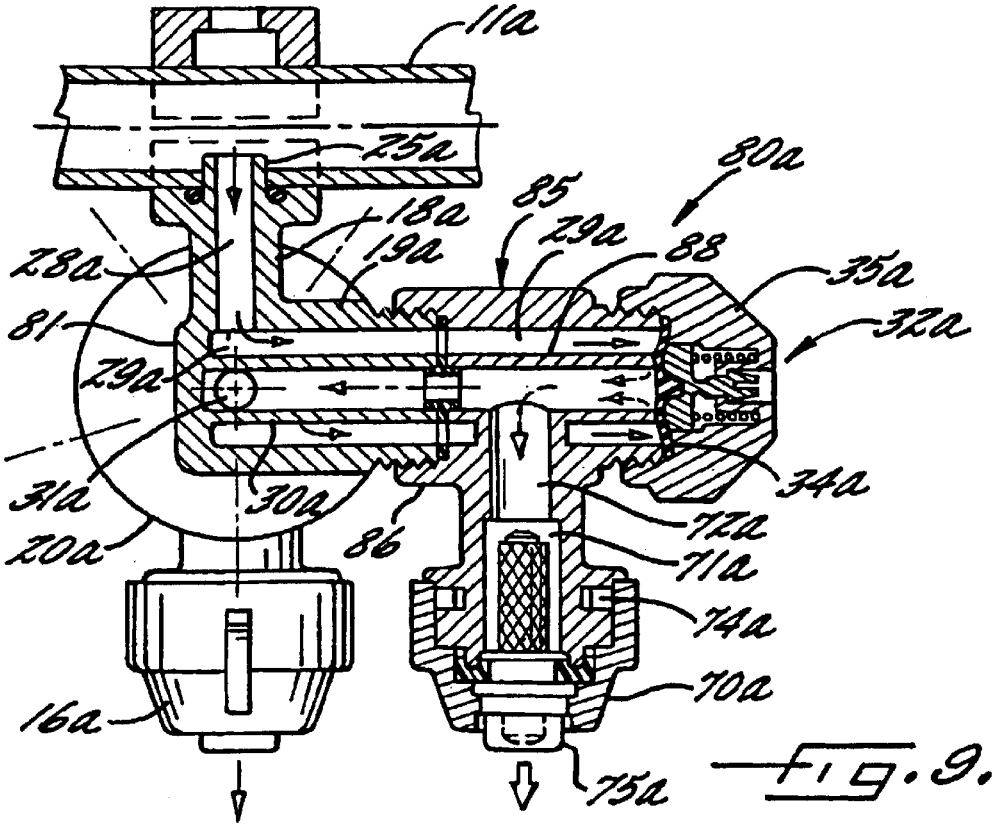
FIG. 9 is a vertical section of the spray nozzle assembly shown in FIG. 8 taken in the plane of line 9—9.

In carrying out a further aspect of the invention, an adaptor is provided which enables easy field retrofitting of conventional turret spray nozzles into a nozzle assembly according to the present invention. Referring now to FIGS. 8 and 9, there is shown a spray nozzle assembly 80 wherein items similar to those described above have been given similar reference numerals with the distinguishing suffix "a" added. The spray nozzle assembly 80*a* in this instance includes a nozzle body 81 of a conventional type having a turret 15*a* identical to that described above. Like the nozzle body previously described, the nozzle body 81 includes a mounting and liquid inlet section 18*a*, a check valve hub section 19*a* and a turret mounting section 20*a*. Consistent with the prior art, the hub section 19*a* has a threaded end onto which a check valve cap 35*a* is mountable.

In carrying out this aspect of the invention, an auxiliary nozzle adaptor 85 is provided which upon removal of the check valve cap 35 from the conventional check valve hub section 19*a* can be secured on the threaded end of the hub section 19*a* of the conventional body 81 to enable an alternative high capacity spraying. The adaptor 85 in this case includes a cylindrical hub section 86 having an upstream internally threaded end for mounting on the threaded end of the body hub section 19*a*, and an externally threaded downstream end for receiving the threaded check valve cap 35. The adaptor 85 includes a horizontal tube 88 that is mounted in aligned relation with the tube 30*a* of the body hub section 19*a* for effectively increasing the length of the annular hub section passage 19*a* and the internal passage defined by the tube 30*a*. Hence, pressurized liquid entering the inlet passage 28*a* will communicate through the annular passage 29*a* past the anti-drip check valve 35*a*, and proceed through the tube 88 in the reverse direction to the passage 29*a* to the turret mounting section 20*a*, and ultimately to a turret nozzle 16*a* at the discharge position.

In keeping with the invention, the adaptor 85 includes an integral downwardly extending stem 71*a* having a stem passageway 72*a* communicating with the tube 88 and camming and locking lugs 74*a* receiving a quick disconnect nozzle 70*a* similar to that described above. Liquid entering check valve tube 88 will be directed to the auxiliary nozzle 70*a* through a substantially shorter length flow path of travel, with lesser turns, and with lesser pressure losses than liquid communicated to a turret nozzle 16*a*. The auxiliary stem passage 72*a* therefore again may be made larger in size and accommodate substantially greater liquid flow than the stem passages for the turret nozzles 16. It will be understood that a conventional turret spray nozzle assembly may be readily converted in the field simply by unscrewing the check valve cap 35, mounting the adaptor 85 in its place, and screwing the check valve cap 35 onto the end of the adaptor 85.

From the foregoing, it can be seen that a turret-type spray nozzle is provided which enables selective direction of a relatively higher volume liquid spray for a given liquid pressure inlet. Hence, the spray nozzle assembly includes a multiplicity of spray nozzles that can be selectively used in spraying and which a substantially greater volume of liquid may be directed from at least one of the spray nozzles for a given inlet pressure than from any of the other nozzles. Yet, the spray nozzle assembly is relatively simple in construction and permits conventional turret spray nozzles to be easily converted to achieve the operation advantages of the present invention.

What is claimed is:

1. A spray nozzle assembly comprising:

a nozzle body having a liquid inlet, a turret mounting section, and an auxiliary nozzle mounting section, a turret rotatably mounted on said turret mounting section and having a plurality of turret nozzles, said turret being rotatable on said turret mounting section to locate any selected one of said turret nozzles in an operative spraying position such that said selected one of said turret nozzles is operable for directing a liquid spray in a predetermined direction, an auxiliary nozzle mounted on said body auxiliary nozzle mounting section for directing a liquid spray in a direction parallel to the liquid spray directed from said selected one of said turret nozzles in said operative spraying position, said body defining a turret nozzle liquid flow passage communicating between said liquid inlet and a turret nozzle located in said operative position for supplying liquid to be sprayed by said located turret nozzle, said body defining an auxiliary nozzle liquid flow passage, different from said turret nozzle liquid flow passage, communicating between said liquid inlet and said auxiliary nozzle for supplying liquid to be sprayed by said auxiliary nozzle, and said auxiliary nozzle liquid flow passage making fewer turns than said turret nozzle liquid flow passage.

2. The spray nozzle assembly of claim 1 in which said auxiliary nozzle liquid flow passage is shorter in length than said turret nozzle liquid flow passage.

3. The spray nozzle assembly of claim 1 in which said turret nozzle liquid flow passage effects lesser pressure losses on liquid traveling between said liquid inlet and said auxiliary nozzle than the pressure losses incurred by liquid traveling between said liquid inlet and a turret nozzle located at said operative position.

4. The spray nozzle assembly of claim 1 in which each of said turret nozzles is a quick disconnect nozzle adapted for removable mounting on said turret, and said auxiliary nozzle is a quick disconnect nozzle adapted for removable mounting on said auxiliary mounting section.

5. The spray nozzle assembly of claim 1 in which said auxiliary nozzle mounting section and said auxiliary nozzle are disposed below said liquid inlet and said turret mounting section is located below and laterally to one side of said liquid inlet.

6. The spray nozzle assembly of claim 1 in which said turret includes a generally cylindrical hub mountable on said turret mounting section and a plurality of radial stems each extending radially outwardly of said hub and having a central liquid flow passage, said turret spray nozzles each being removably mounted on one of said stems, and said turret liquid flow passage communicates from said liquid inlet, axially into said turret mounting section and to the central passage of the mounting stem of a turret nozzle located in said operative position.

7. The spray nozzle assembly of claim 6 in which said turret nozzle liquid flow passage makes a right angle bend between said liquid inlet and the portion of the turret nozzle flow passage thereof that communicates axially into said turret section, and said auxiliary mounting stem and auxiliary nozzle are disposed directly below said liquid inlet.

8. The spray nozzle assembly of claim 1 in which said turret nozzle liquid flow passage includes an inlet passage communicating with said inlet, a turret mounting section passage in fluid communication with and disposed at a right angle to said inlet passage, and a turret nozzle mounting section passage communicating at a right angle to said turret mounting section passage, and said auxiliary nozzle liquid flow passage includes an inlet passage communicating with said liquid inlet, and an auxiliary nozzle mounting section passage communicating with said inlet passage.

9. The spray nozzle assembly of claim 8 in which said auxiliary nozzle mounting section passage is disposed below and in substantial axial alignment with said inlet passage.

10. The spray nozzle assembly of claim 8 in which said auxiliary nozzle mounting section passage is larger in diameter than said turret nozzle mounting section passage.

11. The spray nozzle assembly of claim 10 in which said auxiliary nozzle mounting section passage is at least about 15 percent larger in diameter than said turret nozzle mounting section passage.

12. The spray nozzle assembly of claim 1 in which said auxiliary nozzle liquid flow passage is designed to enable spraying of at least about twice the liquid volume the turret nozzle liquid flow passage enables any one of the turret nozzles located in said operative position to spray.

13. The spray nozzle assembly of claim 1 in which said turret nozzle liquid flow passage includes an inlet passage communicating with said liquid inlet, a check valve passage communicating at a right angle to said inlet passage, a turret mounting section passage communicating at a right angle with said check valve passage, and a turret nozzle mounting section passage communicating at a right angle to said turret mounting section passage, and said auxiliary nozzle liquid flow passage includes said inlet passage communicating with said liquid inlet, said check valve passage communicating at a right angle to said inlet passage, and an auxiliary nozzle mounting section passage communicating at a right angle to said check valve passage.

14. The spray nozzle assembly of claim 1 in which said turret includes a hub rotatably mounted on said turret mounting section, said turret nozzle liquid flow passage includes a passage communicating axially into said hub and a right angle exit passage communicating radially through said turret mounting section, and said turret having a plurality of circumferentially spaced radially extending turret nozzle mounting stems, and said turret nozzle mounting stems each having a passageway communicating between a turret spray nozzle mounted on the stem and said turret mounting section exit aperture when the turret nozzle is located in said operative spraying position.

15. The spray nozzle assembly of claim 1 in which said nozzle body includes a liquid inlet section which defines an inlet passage communicating with said liquid inlet, a check valve hub section disposed below said liquid inlet section, and said turret mounting section being disposed laterally to one side of said check valve hub section, and said auxiliary nozzle mounting section being located below said check valve hub section.

16. The spray nozzle assembly of claim 1 in which said turret mounting section and auxiliary nozzle mounting sections are integrally formed parts of said nozzle body.

17. The spray nozzle assembly of claim 1 in which said nozzle body turret mounting section is disposed in perpendicular relation to said nozzle body auxiliary nozzle mounting section.

18. A spray nozzle assembly comprising a nozzle body having a liquid inlet, a turret mounting section, and an auxiliary nozzle mounting section, a turret rotatably mounted on said turret mounting section and having a plurality of turret nozzles, said turret being rotatable on said turret mounting section to locate any selected one of said turret nozzles in an operative spraying position, an auxiliary nozzle mounted on said body auxiliary nozzle mounting section, said body defining a turret nozzle liquid flow passage communicating between said liquid inlet and a turret nozzle located in said operative position for supplying liquid to be sprayed by said located turret nozzle, said body defining an auxiliary nozzle liquid flow passage, different from said turret nozzle liquid flow passage, communicating between said liquid inlet and said auxiliary nozzle for supplying liquid to be sprayed by said auxiliary nozzle, and said auxiliary nozzle liquid flow passage making fewer turns and being shorter in length than said turret nozzle liquid flow passage.

19. The spray nozzle assembly of claim 18 in which said auxiliary nozzle liquid flow passage is designed to enable a greater liquid flow volume to and through said auxiliary nozzle than said turret nozzle liquid flow passage enables to and through any selected one of the turret nozzles.

20. The spray nozzle assembly of claim 18 in which said auxiliary nozzle liquid flow passage effects lesser pressure losses on liquid traveling between said liquid inlet and said auxiliary nozzle than the pressure losses incurred by liquid traveling between said liquid inlet and a selected one of said turret nozzles.

21. The spray nozzle assembly of claim 18 in which said auxiliary nozzle is disposed below said liquid inlet and said turret spray nozzles are located below and laterally to one side of said liquid inlet.

22. The spray nozzle assembly of claim 18 in which said turret spray nozzles are each mounted on a respective mounting stem having a flow passage, said turret nozzle liquid flow passage including the mounting stem flow passage of a turret nozzle selected for receiving liquid to be sprayed, and said body includes an auxiliary nozzle mounting stem having a central flow passage, and said auxiliary nozzle liquid flow passage includes said auxiliary mounting stem central flow passage.

23. The spray nozzle assembly of claim 22 in which the auxiliary nozzle mounting stem passage is larger in diameter than each of the turret nozzle mounting stem flow passages.

24. The spray nozzle assembly of claim 23 in which said auxiliary nozzle mounting stem central passage is at least 15% larger in diameter than each of the turret nozzle mounting stem flow passages.

25. The spray nozzle assembly of claim 18 in which said auxiliary nozzle liquid flow passage is designed to enable spraying of at least about twice the liquid volume the turret nozzle liquid flow passage enables any selected one of the turret nozzles to spray.

* * * * *